US007224931B2

(12) United States Patent
Ide et al.

(10) Patent No.: US 7,224,931 B2
(45) Date of Patent: May 29, 2007

(54) IMAGE FORMING APPARATUS AND IMAGE FORMING METHOD

(75) Inventors: Naoaki Ide, Tokyo (JP); Kazushige Morihara, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 280 days.

(21) Appl. No.: 11/009,920

(22) Filed: Dec. 10, 2004

(65) Prior Publication Data

US 2005/0135853 A1 Jun. 23, 2005

(30) Foreign Application Priority Data

Dec. 19, 2003 (JP) ..... 2003-422834

(51) Int. Cl.
*G03G 15/08* (2006.01)
*G15G 15/22* (2006.01)

(52) U.S. Cl. ..... 399/366; 399/130; 399/200

(58) Field of Classification Search ..... None
See application file for complete search history.

(56) References Cited

FOREIGN PATENT DOCUMENTS

JP 8-37595 7/1994

*Primary Examiner*—Judy Nguyen
*Assistant Examiner*—N. Ha
(74) *Attorney, Agent, or Firm*—SoCal IP Law Group LLP; Steven C. Sereboff

(57) ABSTRACT

The CPU of the image forming apparatus sets up an ADF reading magnification in the ADF driving unit including the motor and the motor driver referring to the first magnification conversion table in the memory of the system unit when reading a document image while a document is being moved. Further, the reading magnification that is also in the ADF driving unit is also set in the specific document detection unit. The specific document detection unit makes the pattern matching as to whether the read image data is that of a specific document using the magnification dictionary (specific image data) that is set and outputs a detection signal as the result of the matching to the CPU. As that time, the CPU controls the output of the applicable read image data by a printer according to the detection signal.

13 Claims, 6 Drawing Sheets

RELATION OF THE SPECIFIC DOCUMENT RECOGNITION RATES WHEN THERE ARE DIFFERENCES BETWEEN MAGNIFICATIONS SET IN THE ADF DRIVER OR THE SCANNER DRIVER AND MAGNIFICATIONS THAT ARE SET IN THE SPECIFIC DOCUMENT DETECTION UNIT.

32

FIRST MAGNIFICATION CONVERSION TABLE

| | CONTROL PANEL SET COPYING MAFNIFICA-TION (%) | ADF READING MAGNIFICATION (%) | DOCUMENT MOVING SPEED (mm/s) | DOCUMENT CONVEY DRIVING MOTOR (pps) |
|---|---|---|---|---|
| NO.1 | 100 | 95 | 220.5 | 5250 |
| NO.2 | 100 | 95.1 | 220.29 | 5245 |
| ⋮ | ⋮ | ⋮ | ⋮ | ⋮ |
| NO.51 | 100 | 100 | 210 | 5000 |
| ⋮ | ⋮ | ⋮ | ⋮ | ⋮ |
| NO.101 | 100 | 105 | 199.5 | 4750 |

FIG. 3

33

SECOND MAGNIFICATION CONVERSION TABLE

| | CONTROL PANEL SET COPYING MAFNIFICA-TION (%) | SCANNER READING MAGNIFICATION (%) | SCANNER MOVING SPEED (mm/s) | SCANNER DRIVING MOTOR (pps) |
|---|---|---|---|---|
| NO.1 | 100 | 95 | 220.5 | 6417.6 |
| NO.2 | 100 | 95.1 | 220.29 | 6411.5 |
| ⋮ | ⋮ | ⋮ | ⋮ | ⋮ |
| NO.51 | 100 | 100 | 210 | 6112.0 |
| ⋮ | ⋮ | ⋮ | ⋮ | ⋮ |
| NO.101 | 100 | 105 | 199.5 | 5806.4 |

FIG. 4

RELATION OF THE SPECIFIC DOCUMENT RECOGNITION RATES WHEN THERE ARE DIFFERENCES BETWEEN MAGNIFICATIONS SET IN THE ADF DRIVER OR THE SCANNER DRIVER AND MAGNIFICATIONS THAT ARE SET IN THE SPECIFIC DOCUMENT DETECTION UNIT.

IMAGE FORMING APPARATUS AND IMAGE FORMING METHOD

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by any one of the patent disclosure as it appears in the Patent and Trademark Office patent files or records, but otherwise reserves all copyright and trade dress rights whatsoever.

RELATED APPLICATION INFORMATION

This application is based upon and claims the benefit of priority from the prior Japanese Patent Application No. 2003-422834, filed on Dec. 19, 2003; the entire contents of which are incorporated herein by reference.

BACKGROUND OF THE INVENTION

1. Field of the Invention

The present invention relates to an image forming apparatus such as a color copier, etc. equipped with a device to make the judgement as to whether input images are specific documents such as banknotes, securities, etc. and an image forming method.

2. Description of the Related Art

In a conventional color multi-functional image forming machine, when the copying is made, a document was placed and fixed on a document table and a document image was read by moving a scanner (hereinafter, this operation is described as a fixed document reading). Further, in a color multi-functional image forming machine, a means to detect a specific document and a means to smear away the whole surface of the image data when a specific document is detected by this detecting means in order to prohibit the copying of the specific document.

In recent years, with the speed-up of the color copying process, a system with an automatic document feeder (hereinafter, described as an ADF) installed to a color multi-functional image forming machine to read document images by a reading device while moving the document is increasing used.

In the Japanese Patent Application Publication No. 8-37595, a technology to make the judgement as to whether input images are specific documents such as banknotes, securities in a color copier using an ADF equipped with a specific image discriminator is disclosed.

However, a system equipped with an ADF to read images of documents, which are being moved, is susceptible to color shift by vibrations or other factors when compared with a conventional system to read fixed documents using a scanner that is moving. Accordingly, there is such a fear that a recognition rate of a specific document sensor retained by a color multi-functional image forming machine may drop depending upon kinds of specific documents such as banknotes, securities, etc.

On the other hand, a reading magnification (a reading speed) of a color multi-functional image forming machine equipped with such an ADF is normally adjusted for a simple body of scanner or a simple body of ADF at the time when an apparatus is assembled or installed so that the set copying magnification comes to agree with a copied image output from a printer. Definitely, when a document is read actually using an ADF and a scanner and the copied image is output by the printer, the magnifications of the scanner and the ADF are finely adjusted, respectively and the magnification of the copied image is adjusted properly. For example, when a magnification being set with a control panel is 100%, the scanner magnification is set to 99%, or the ADF magnification is set to 98% so that the image outputted by the printer may become 100%.

Furthermore, since the reading magnification read by the scanner or ADF was different as described above when the magnification inputted from the control panel is set as a specific document detection unit, there was a problem that a recognition rate further falls.

SUMMARY OF THE INVENTION

An object of the present invention is to provide an image forming apparatus and an image forming method capable of preventing a recognition rate by a specific document detection unit from falling even in a system to read document image while a document is moving.

According to the embodiments of the present invention, there is provided an image forming apparatus to read document image using an automatic document feeder and form an image based on the read image data comprising: copying magnification set-up means for setting copying magnifications; memory means for storing data showing reading magnification corresponding to the copying magnification set by the copying magnification set-up means when reading document images using the automatic document feeder; control means for controlling the document conveying speed of the automatic document feeder based on the data showing the reading magnification; specific document detection means for detecting whether an image data read from the document conveyed at a conveying speed controlled by the control means is an image data of a specific document; and image forming means for forming an unusable image or an unreadable image on a paper when the specific document detection means detects the image data of the specific document.

Further, according to the embodiments of the present invention, there is provided an image forming method to read a document image using an automatic document feeder and form an image based on the read image data comprising: storing data showing a reading magnification corresponding to a set copying magnification into a memory when a copying magnification is set; controlling a document conveying speed of the automatic document feeder based on the data showing the reading magnification stored in the memory; detecting as to whether the image data read from a document conveyed at the controlled conveying speed is a specific document; and forming an unusable image or an unreadable image on a paper when the image data of the specific document is detected.

DESCRIPTION OF THE DRAWINGS

FIG. 3 shows a first magnification conversion table;

FIG. 4 shows a second magnification conversion table;

DETAILED DESCRIPTION OF THE INVENTION

Figure 1:
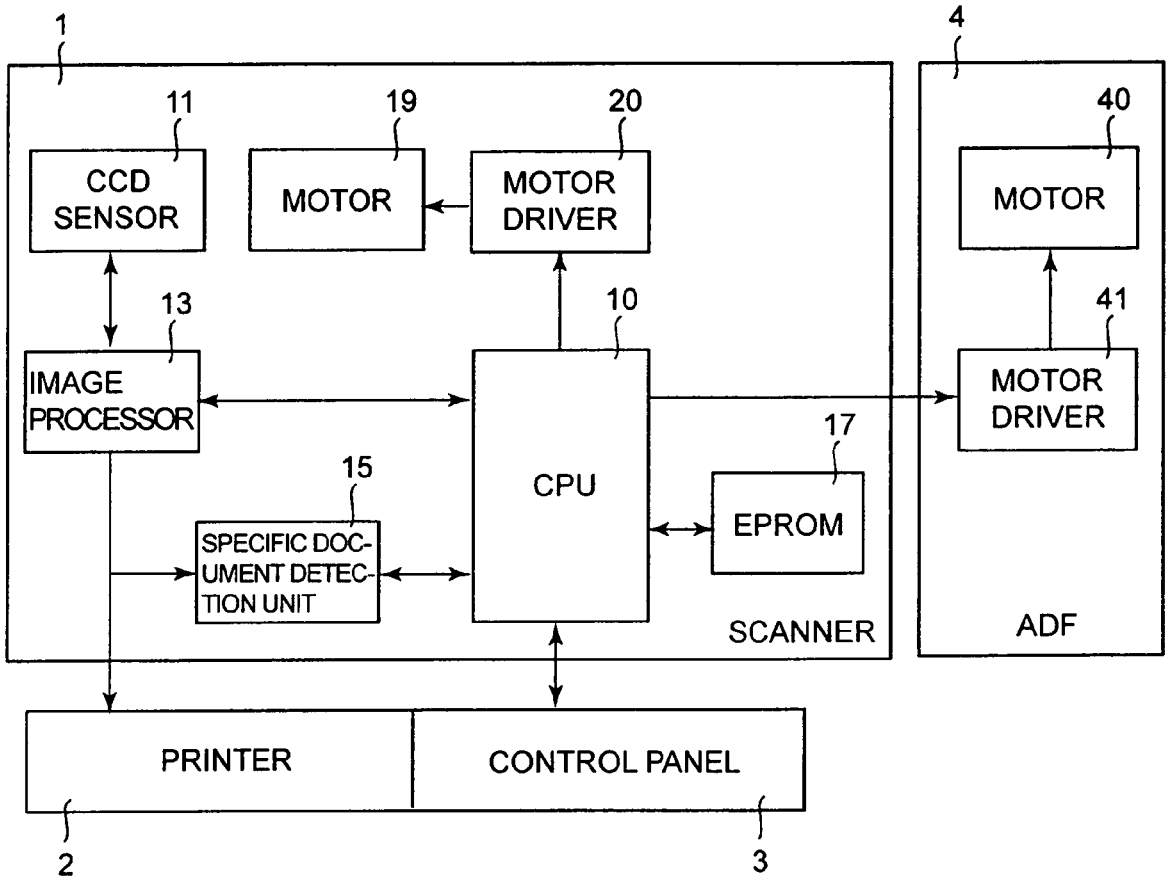
FIG. 1 is a block diagram showing a schematic structure of a color multi-functional image forming machine equipped with a specific document detection unit in one embodiment of the image forming apparatus of the present invention.

Preferred embodiments of the present invention will be described below in detail referring to the drawings.

FIG. 1 shows a color multi-functional image forming machine equipped with a specific document detection unit in an embodiment of the image forming apparatus of the present invention. That is, the color multi-functional image forming machine comprises a scanner 1, a printer 2, a control panel 3 and an automatic document feeder (ADF) 4.

The scanner 1 comprises a CPU 10 to control the entire scanner, a CCD sensor 11 comprising plural line sensors for colors, an image processor 13 to perform the image processing, a specific document detection unit 15 to detect specific documents, a dictionary (specific image data), an EPROM 17 storing a control program, etc., a motor 19 for operating a scanner driver (not shown), and a motor driver 20 to drive the motor 19.

The printer 2 is controlled by a CPU (not shown) and forms an image on a paper based on image data.

The control panel 3 has a ten-key, an LC display, etc. which are not shown, and a copying magnification, the number of output sheets, etc. are input by user.

The ADF 4 has an ADF driver including the motor 40 and the motor driver 41 and feeds a document placed on a document feed table and reads its image data while it is moving.

Figure 2:
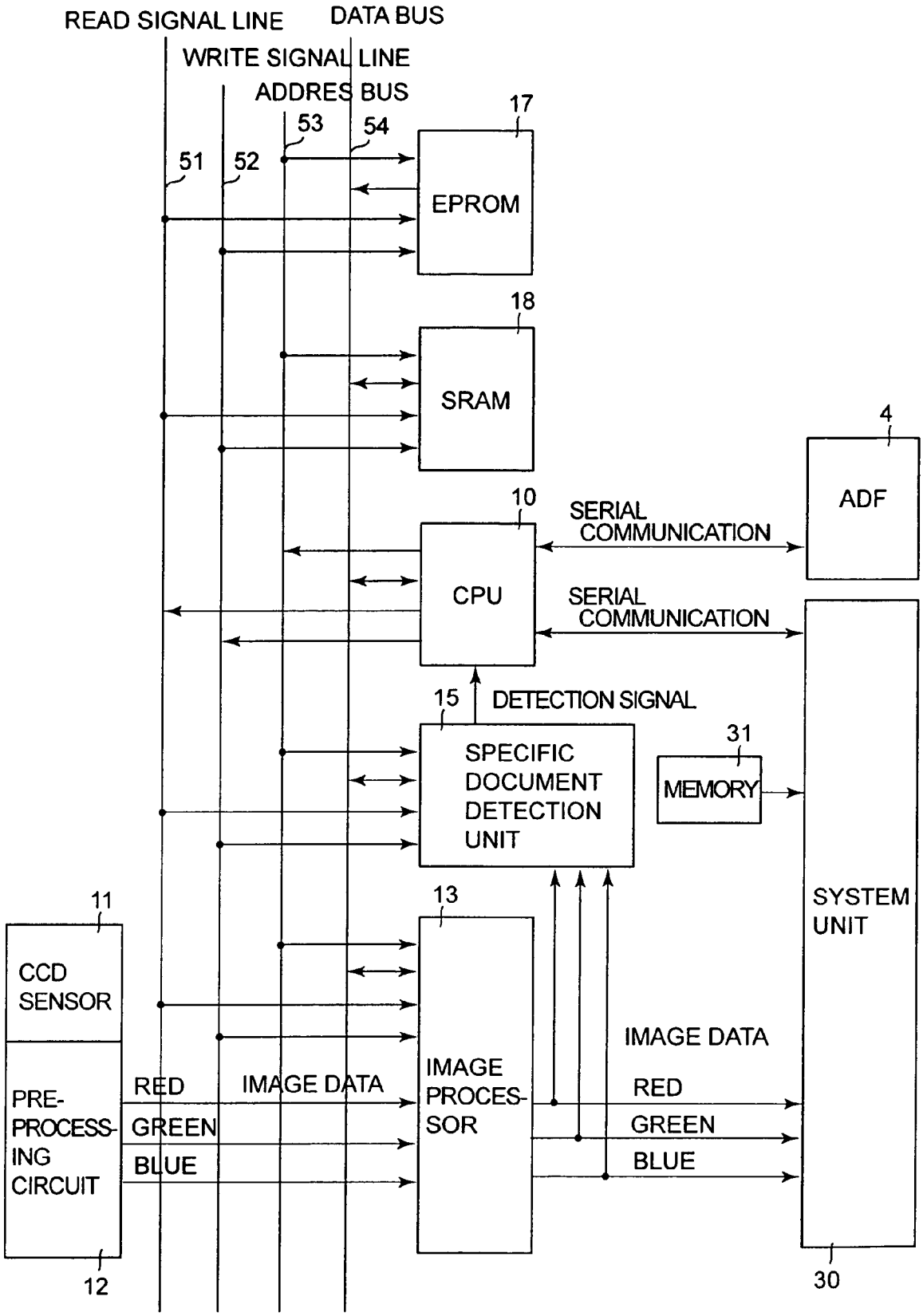
FIG. 2 is a block diagram showing the detailed structure around the specific document detection unit.

FIG. 2 shows the detailed construction around the specific document detection unit 15. That is, red, green and blue image data read by the CCD sensor 11 are input into a pre-processing circuit 12□ The pre-processing circuit 12 performs the pre-processing including amplification, A/D conversion, etc. of input image data (red, green and blue) and outputs the image data to the image processor 13.

The image processor 13 makes the shading correction, in-line correction, etc. of the input image data (red, green and blue) and outputs the processed image data to the specific document detection unit 15 and a system unit 30.

A dictionary (specific image data) for detecting specific documents read from the EPROM 17 by the CPU 10 is downloaded in advance in the specific document detection unit 15. The specific document detection unit 15 makes the pattern matching of read image data with the dictionary (the specific image data) corresponding to a magnification and detects that are set whether the received image data is that of a specific document and outputs a detection signal to the CPU 10.

Further, there is a SRAM 18 provided as a work memory jointly with the EPROM 17.

The image processor 13 is connected to the specific document detection unit 15, the EPROM 17 and the SRAM 18 with a read signal line 51, a write signal line 52, an address bus 53, and a data bus 54.

The CPU 10 and the ADF 4 are connected each other through the serial communication.

Also, the CPU 10 and the system unit 30 are connected each other through the serial communication.

The system unit 30 has a memory 31 and connected to the printer 2 and the control panel 3, which sets a copying magnification shown in FIG. 1. A first magnification conversion table 32 (shown in FIG. 3) storing ADF reading magnifications corresponding to copying magnifications set by user through the control panel 3 and used when a mode to read image while moving a document is selected and a second magnification conversion table 33 (shown in FIG. 4) storing scanner reading magnifications corresponding to copying magnifications when a mode to read images by the scanner moving to a fixed document is selected by user are stored in the memory 31.

The values stored in the first magnification conversion table 32 and the second magnification conversion table 33 are set up, respectively when the color multi-functional image forming machine was assembled/adjusted.

Figure 5:
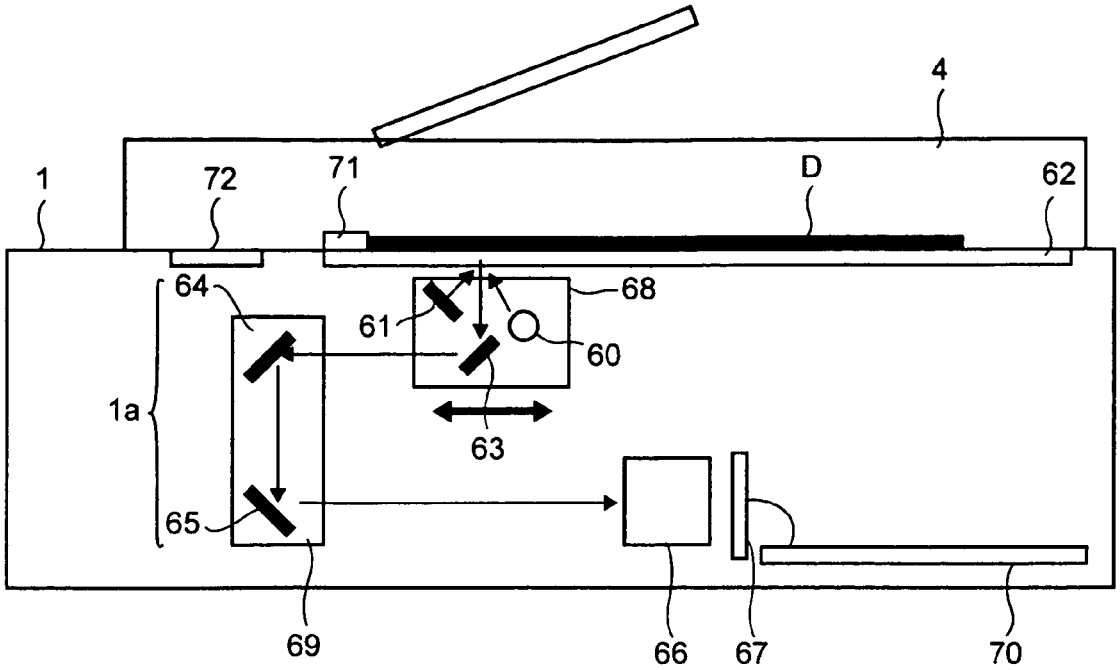
FIG. 5 is a schematic cross sectional view showing a scanner which read an image of a document.

FIG. 5 shows the cross sectional view of the scanner 1 when reading a document image using the scanner 1.

The scanner 1 includes a light source 60, a reflector 61, a document table 62, a first mirror 63, a second mirror 64, a third mirror 65, a lens 66, and a CCD sensor 67.

The light irradiated from the light source 60 and the light irradiated from the light source 60 and reflected on the reflector 61 are irradiated to a document D, and its reflecting light is focused on the CCD sensor 67 through the first mirror 63, the second mirror 64, the third mirror 65 and the lens 66.

The document D is fixed by the document holding plate installed to the ADF 4. The light source 60 is driven by an inverter that is not shown. The light source 60, the inverter, the reflector 61 and the first mirror 63 are installed to the first carriage 69. The second mirror 64 and the third mirror 65 are installed to the second carriage 69.

A controller board 70 is arranged in the scanner. The CCD sensor 67 is installed on the controller board 70. The controller board 70 drives the CCD sensor 67, controls the scanner 1 and controls the communication with the system unit (not shown).

When reading an image of the document D that is fixed on the document table 62, the first carriage 68 and the second carriage 69 are first moved to the position of the scanning original point by the rotation of the scanner driving motor (not shown). After the light source 60 is turned on, the first and second carriages 68 and 69 are moved to the lower position of the shading correcting plate (the white reference plate) 71 and read the shading correction plate 71. Based on the result of reading the shading correction plate 71, the shading correction is executed.

Then, the first carriage 68 is moved to the position below the document D and the image on the whole surface of the document D is read. The second carriage 69 moves at a speed that is half of the moving speed of the first carriage 68 and maintains the length of the optical path from the surface of the document D to the CCD sensor 66.

The reflected light from the surface of the document D is converted into an analogue signal through the photoelectric transfer by the CCD sensor 66. Further, this analogue signal is amplified in the controller board 70 and then, the A/D conversion and the shading correction are executed. The shading corrected analogue signal is converted into the digital signal. Based on the digital signal, the image process is made and the image processed signal is output to the outside of the scanner 1 as image data. The form of process to read an image on the whole surface of the document D by scanning the underside of the document D with the first carriage equipped with the light source 60, the inverter, the reflector 61 and the first mirror 63 and the second carriage equipped with the second mirror 64 and the third mirror 65 is stipulated as the first scanning function 1*a* for the "Reading of Fixed Document Image" which will be described later.

Figure 6:
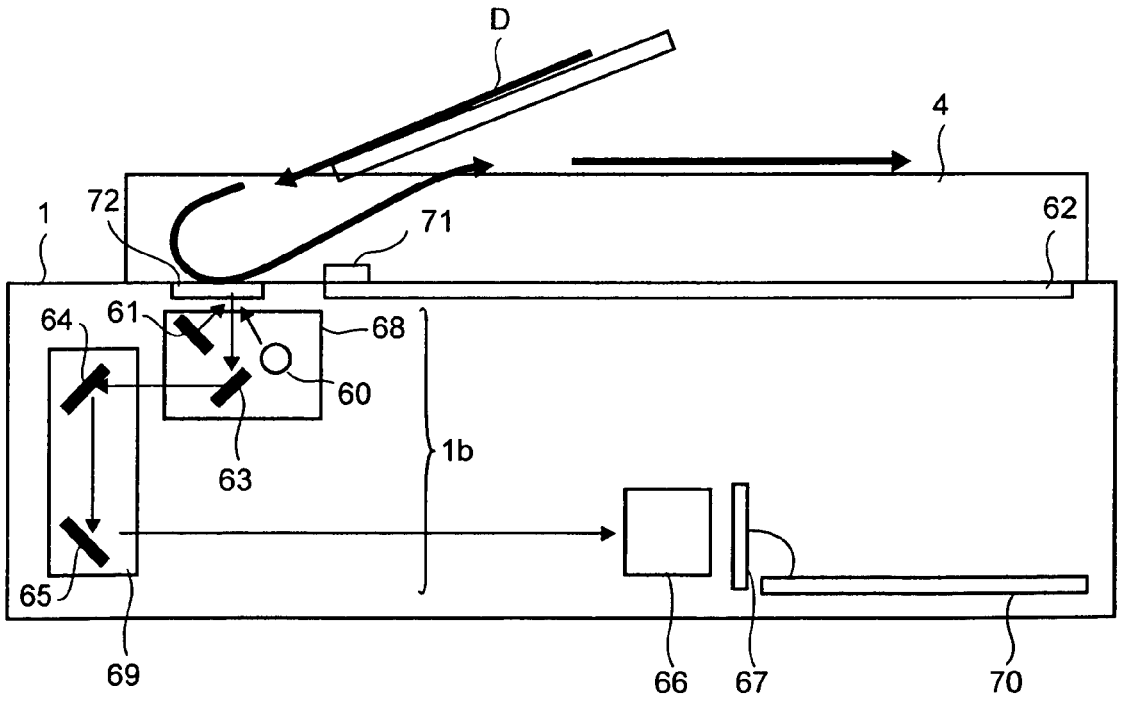
FIG. 6 is a schematic cross sectional view showing a scanner abd ADF which read an image of a document.

FIG. 6 shows the cross sectional view of the scanner 1 when reading an image of the document D with the ADF 4.

The light irradiated from the light source 60 and the light irradiated from the light source 60 and reflected on the reflector 61 are irradiated to the document D on the document table 62, and its reflecting light is focused on the CCD sensor 67 by the lens 66 through the first mirror 63, the second mirror 64, and the third mirror 65.

The document D that is set in the ADF 4 is conveyed by conveying rollers and a conveyor belt driven by a document conveying driving motor (not shown) provided in the ADF 4, and passing on the contact glass 72 and discharged from the conveying unit.

When reading an image of the document D, the first carriage 68 and the second carriage 69 are first moved to the position of the scanning original point and after turning the light source 60 on, moved to the under side of the shading correction plate 71 and read the shading correction plate 71. Based on the read result of the shading correction plate 71, the shading correction is executed.

Next, the first carriage 68 is fixed under the contact glass 72 and the reflecting light from the surface of the conveyed document D is received by the CCD sensor 67. This received light is converted into analogue signal through the photoelectric transfer. The analogue signal is further amplified in the controller board 70 and then, the A/D conversion and the shading correction are executed. The shading corrected analogue signal is converted into digital signal. Based on this digital signal, the image process, etc. are performed and the image processed signal is output to the outside of the scanner 1 as image data. The form of process to read an image on the whole surface of the document D conveyed by the ADF 4 with the first carriage 68 equipped with the light source 60, the inverter, reflector 61 and the first mirror 63 fixed under the contact glass 72 and the second carriage equipped with the second mirror 64 and the third mirror 65 also fixed is stipulated as the second scanning function 1*b* for "Reading of Moving Document Image" which will be described later.

Figure 7:
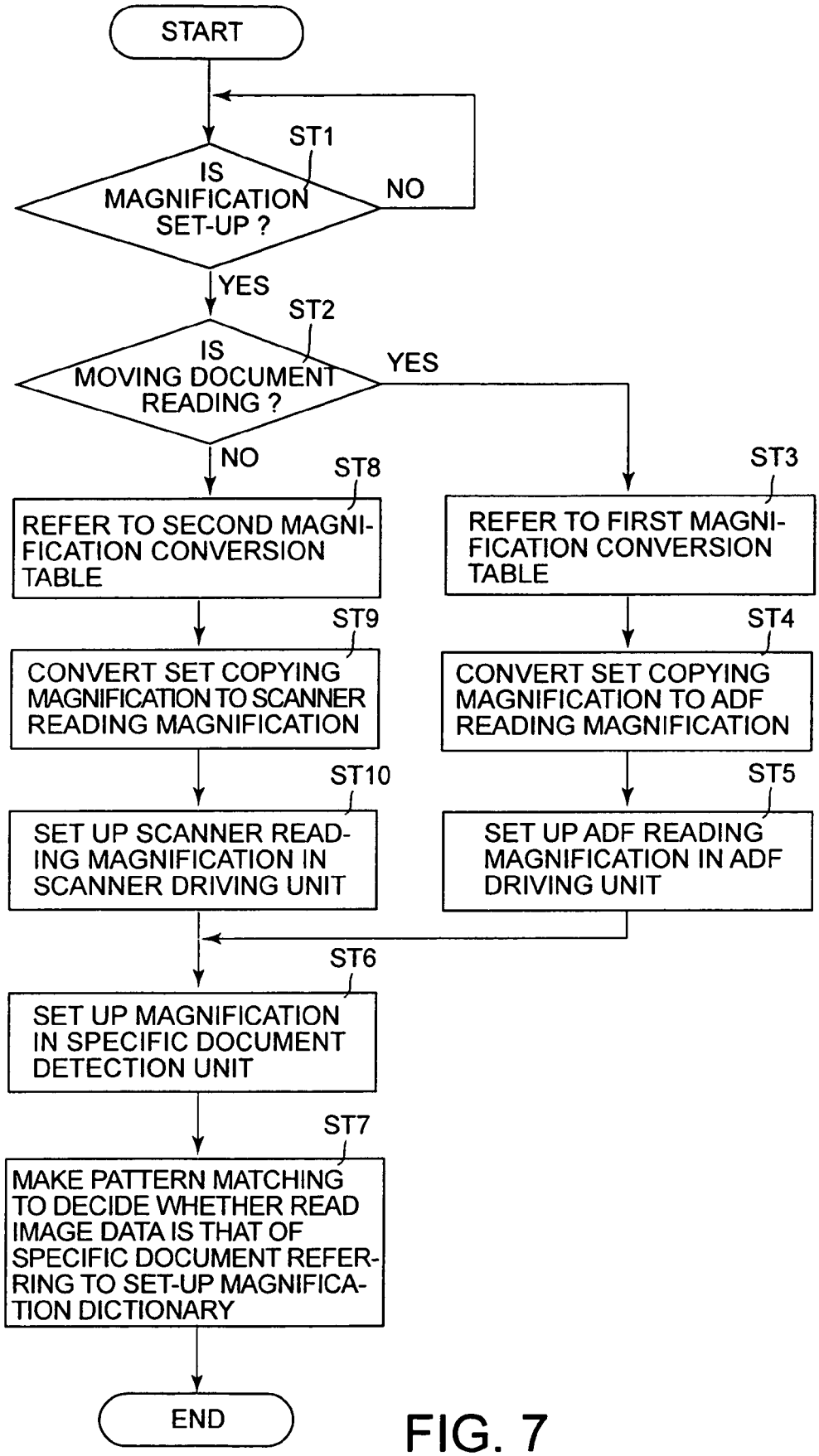
FIG. 7 is a flowchart for explaining the specific document detection operation.

Next, the specific document detecting operation in the color multi-functional image forming machine in the structure as described above will be explained referring to the flowchart shown in FIG. 7.

First, when a copying magnification is set by user through the control panel (ST 1), the CPU 10 judges whether a document image is read while the document D is moving from the ADF 4, that is the first scanning function 1*b* is performed, or the image is read from the document D placed on the document table 62 by the moving scanner, that is the second scanning function 1*a* is performed (ST2).

When the image is read while the document D is moving, which the second scanning function 1*b* (FIG. 6) is performed, the CPU refers to the first magnification conversion table 32 in the memory 31 of the system unit 30 (ST3), converts the set magnification rate to the ADF read magnification rate (ST4), and sets the ADF read magnification rate in the ADF driver (not shown) including the motor 40 and the motor driver 41 (ST5). For example, when a document image is expanded to 104.9% when it was finally printed on a paper even when the copy magnification rate was set at 100% through the control panel 3, the data set on Line No. 2 of the first magnification conversion table 32 is referred to. And then, the ADF reading magnification is set at 95.1% inversely. That is, the revolution speed of the motor 40 for driving the document conveying should be set at 5245 pps so that the document conveying speed becomes 220.29 mm/s. As a result, the document image is printed out at a 100% size finally as desired by user. Further, when finally printed on a paper, an image is contracted to a size of 95% although the copying magnification is set at 100% through the control panel 3, the data set on Line No. 101 of the first magnification conversion table 32 is referred to, and the ADF reading magnification is set at 105% inversely. That is, the revolution speed of the motor 40 for driving the document conveying should be set at 4750 pps so that the document conveying speed becomes 199.5 mm/s. As a result, the document image is printed out in a size of 100% finally as desired by user. In the first magnification conversion table 32, data are set in a step of 0.1% from No. 1 to No. 101 and magnifications can be adjusted at a high accuracy.

Further, the CPU 10 sets the magnifications that are set in the ADF driver also in the specific document detection unit 15 (ST6).

Then, the specific document detection unit 15 performs the pattern matching to determine whether the read image data is read from a specific document using a dictionary (specific image data) of the set magnification and outputs a detection signal as a result of the pattern matching to the CPU 10 (ST7). At this time, the CPU 10 controls the output of the applicable read image data by the printer 2 according to the detection signal. When the detection signal is the signal detecting a specific document, the CPU 10 prohibits the output of the applicable read image data. That is, an image corresponding to the read image data is not formed on a paper. In concreat terms, a white paper is output or a smeared away image is formed on a paper to be unreadable or unusable as an output.

Further, when an image data read by moving the scanner to the document D fixed on the document table 62 instead of the document D that is read while moving it in Step ST2, which the first scanning function 1*a* (FIG. 5) is performed, the CPU 10 refers to the second magnification table 33 in the memory 31 of the system unit 30 (ST8), converts the set magnification into the scanner reading magnification (ST9) and sets the scanner read magnification in the scanner driver (not shown) including the motor 19 and the motor driver 20 (ST10). For example, when an image is enlarged to a size of 105% when finally printed on a paper although the copy magnification was set at 100% through the control panel 3, the data set on Line No. 1 of the second magnification conversion table 33 in FIG. 4 is referred to. Therefore, the scanner reading magnification is set at 95%, inversely. That is, the revolution speed of the motor 19 to drive the scanner should be set at 6417.6 pps so that the scanner moving speed becomes 220.5 mm/s. As a result, the data is printed finally at a size of 100% as desired by user. Further, when the data is contracted to a size of 95% when finally printed although the copying magnification was set at 100% through the control panel 3, the data set on Line No. 101 of the second magnification conversion table 33 shown in FIG. 4 is referred to. Therefore, the scanner reading magnification is set at 105%, inversely. That is, the revolution speed of the scanner driving motor 19 should be set at 5806.4 pps so that the scanner moving speed becomes 199.5 mm/s. As a result, the data is printed at a size of 100% finally as desired by user.

In the second magnification conversion table 33, data is set on the table at a step of 0.1% from Line No. 1 to Line No. 101 and the magnifications can be adjusted at a high accuracy.

Further, in the first magnification conversion table 32 and the second magnification conversion table 33 shown in FIG. 3 and FIG. 4, the magnifications of 100% only that are set through the control panel 3 are shown. Actually, however, data for setting ADF read magnification, document conveying speed, revolution speed of the motor for driving the document convey, scanner reading magnification, scanner moving speed and revolution speed of the scanner driving motor regarding contraction/enlargement magnifications such as 50%/200% are also stored as the magnification conversion tables.

Further, the CPU 10 sets the magnifications that are set in the scanner driver also for the specific document detection unit 15 (ST 10).

Then, the specific document detection unit 15 makes the pattern matching to determine whether the read image data is that of a specific document using the set magnification dictionary (specific image data) and outputs a detection signal as the result of the matching to the CPU 10 (ST7). At this time, the CPU 10 controls the output of the applicable read image data by the printer 2 according to the detection signal. When the detection signal is for the detected specific document, the CPU 10 prohibits the output of the applicable read image data. That is, an image corresponding to the read image data is not formed on a paper. In concreat terms, a white paper is output or a smeared away image is formed on a paper to be unreadable or unusable as an output.

Figure 8:
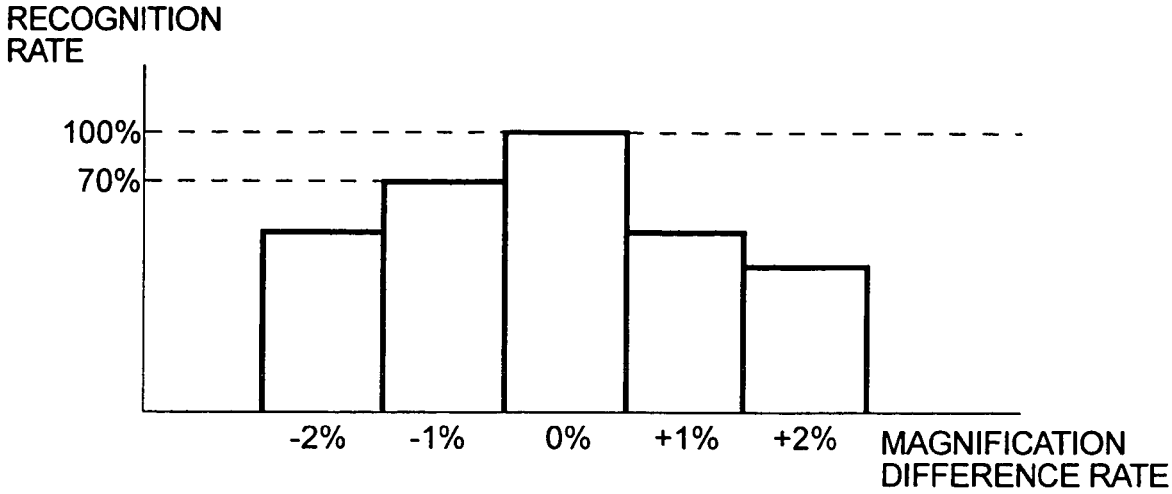
FIG. 8 is a graph showing the relationship of the specific document recognizing rate when differences are in setting magnification.

FIG. 8 shows the relation of a specific document recognition rate when there is a difference between the magnification to be set in the ADF driver or the scanner driver and the magnification to be set in the specific document detection unit 15.

That is, the copying magnification that was set in the control panel 3 was so far set in the specific document detection unit 15 as it is and might differ from the magnification actually set in the ADF driver or the scanner driver.

As a result, in FIG. 8, for example, when a recognition rate is 100% when a magnification difference is 0% and a recognition rate drops to 70% when a magnification difference +1%. When such the magnification difference is generated, an image magnification of the read image data does not match with an image magnification of a dictionary used in the specific document detection unit 15 and the accurate pattern matching cannot be made. As a result, the recognition rate drops.

As explained above, according to the embodiment of the present invention, it is possible to prevent drop of the recognition rate by matching a magnification to be set in the specific document detection unit 15 with a magnification actually set in the ADF driver or the scanner driver by deciding a magnification that is set in the specific document detection unit 15 based on a magnification that is set in the control panel 3.

The image forming apparatus of the present invention, it becomes possible to prevent drop of a recognition rate in the specific document detection by setting actual ADF reading magnification and scanner reading magnification in the specific document detection unit.

In the above explanation, an example of a color multifunctional image forming machine as an image forming apparatus equipped with both of a mode to read document image with a fixed scanner from a document moving using an automatic document feeder and a mode to read document images with a moving scanner from a fixed document was explained. However, this invention is not limited to the above and this invention can be realized with an image forming apparatus equipped with only a mode to read document image with a fixed scanner from a document moving by an automatic document feeder or with an image forming apparatus equipped with only a mode to read document image with a moving scanner from a fixed document.

The present invention is not restricted to the embodiments described above and various changes and modifications may be made at the stage of actual application without departing from the spirit and the scope thereof. Further, the embodiments may be combined as appropriate as could as possible and the combined effect can be obtained. Further, many inventions at various stages are contained in the above-mentioned embodiments and various inventions may be derived by variously combining disclosed structural requirements. For example, when the problems described above can be resolved and the effects described above can be obtained even when several structural requirements are deleted from whole structural requirement shown in the embodiments, the construction with these structural requirement deleted may be derived as another invention.

It is claimed:

1. An image forming apparatus to read document image using an automatic document feeder and form an image based on the read image data comprising:

copying magnification set-up means for setting copying magnifications;

memory means for storing data showing reading magnification corresponding to the copying magnification set by the copying magnification set-up means when reading document images using the automatic document feeder;

specific document detection means for detecting whether an image data read from the document conveyed by the automatic document feeder is an image data of a specific document;

control means for controlling the document conveying speed of the automatic document feeder based on the data showing the reading magnification and for setting the data showing reading magnification in the specific document detection means; and image forming means for forming an unusable image or an unreadable image on a paper when the specific document detection means detects the image data of the specific document.

2. The image forming apparatus as claimed in claim 1, wherein the memory means stores revolution speed data of a driving motor as data for controlling the document conveying speed by the control means.

3. An image forming apparatus to read an image of a fixed document with a moving scanner and form an image based on the read image data comprising:

copying magnification set-up means for setting a copying magnification;

memory means for storing data showing a reading magnification corresponding to a copying magnification set by the copying magnification set-up means when reading image data using the scanner;

specific document detection means for detecting whether an image data read from a document by the scanner is an image data of a specific document;

control means for controlling the moving speed of the scanner based on the data showing the reading magnification and for setting the data showing reading magnification in the specific document detection means; and image forming means for forming an unusable image or an unreadable image on a paper when the specific document detection means detects the image data of the specific document.

4. The image forming apparatus as claimed in claim 3, wherein the memory means stores revolution speed of a scanner driving motor as data for controlling the scanner moving speed by the controller.

5. An image forming apparatus equipped with a scanner which reads images of both documents moving by an automatic document feeder and fixed documents and is fixed when reading moving document images and moved when reading fixed document images, and forms an image based on the read image data, comprising:

memory means for storing a first magnification conversion table that is used when a document is conveyed using the automatic document feeder and reads an image by the scanner and a second magnification conversion table that is used when reading an image by the moving scanner by fixing a document;

specific document detection mans for detecting whether the read image data is that of a specific document;

judging means for judging whether an image that is moving by the automatic document feeder or a document is fixed and read by the moving scanner when a copying magnification is set by the copying magnification set-up means;

first conversion means for converting the copying magnification set using the first magnification conversion table stored in the memory means to the reading magnification using the automatic document feeder when the reading of an image of a document moving using the automatic document feeder was judged by the judging means;

first set-up means for setting the reading magnification that was converted by the first conversion means in the automatic document feeder and the specific document detection means;

second conversion means for converting the copying magnification set using the second magnification conversion table stored in the memory means to the reading magnification by the scanner when the image was read by the moving scanner by fixing a document; and second set-up means for setting the reading magnification converted by the second converting means in the scanner and the specific document detection means.

6. The image forming apparatus as claimed in claim 5, wherein the first magnification conversion table stores revolution speed of a convey driving motor as data to control the document conveying speed, and the second magnification conversion table stores revolution speed data of a scanner driving motor as data to control the scanner moving speed.

7. An image forming method to read a document image using a moving scanner to form an image based on the read image data comprising:

storing data showing a reading magnification corresponding to a set copying magnification into a memory when a copying magnification is set;

scanning the document by the moving scanner based on the data showing the reading magnification stored in the memory;

setting the data showing reading magnification in a specific document detection means;

detecting as to whether the image data read from a document scanned by the moving scanner is a specific document; and forming an unusable image or an unreadable image on a paper when the image data of the specific document is detected.

8. An image forming method of an image forming apparatus equipped with a scanner which reads images of both documents moving by an automatic document feeder and fixed documents and is fixed when reading moving document images and moved when reading fixed document images, to form an image based on the read image data comprising:

storing a first magnification conversion table that is used when a document is conveyed using the automatic document feeder to be read an image by the scanner and a second magnification conversion table that is used when reading an image by the moving scanner by fixing a document in a memory;

judging whether an image that is moving by the automatic document feeder or a document is fixed and read by the moving scanner when a copying magnification is set;

converting the copying magnification that is set using the first magnification conversion table to the first reading magnification using the automatic document feeder when the reading of an image of a document moving using the automatic document feeder was judged in the judging step;

controlling the reading operation using the automatic document feeder using the converted first reading magnification;

detecting whether the image data read using the convened first reading magnification is an image data of a specific document;

converting the copying magnification that is set using the second magnification conversion table to the second reading magnification by the scanner when the reading of an image of a document by the moving scanner by fixing the document was judged in the judging step;

controlling the reading operation of the scanner using the second reading magnification; and detecting whether the image data read using the convened second reading magnification is an image data of a specific document.

9. An image forming apparatus to read document image using an automatic document feeder and form an image based on the read image data comprising:

a control panel to set copying magnifications;

a memory to store data showing reading magnification corresponding to the copying magnification set by the control panel when reading document images using the automatic document feeder;

a specific document detection unit to detect whether an image data read from the document conveyed by the automatic document feeder is an image data of a specific document;

a CPU to control the document conveying speed of the automatic document feeder based on the data showing the reading magnification and to set the data showing reading magnification in the specific document detection unit; and a printer to print an unusable image or an unreadable image on a paper when the specific document detection unit detects the image data of the specific document.

10. The image forming apparatus as claimed in claim 9, wherein the memory stores revolution speed data of a driving motor as data for controlling the document conveying speed by the CPU.

11. An image forming apparatus to read an image of a fixed document with a moving scanner and form an image based on the read image data comprising:

a control panel to set a copying magnification;

a memory to store data showing a reading magnification corresponding to a copying magnification set by the control panel when reading image data using the scanner;

a specific document detection unit to detect whether an image data read from a document by the is an image data of a specific document;

a CPU to control the moving speed of the scanner based on the data showing the reading magnification and to set the data showing reading magnification in the specific document detection unit; and a printer to print an unusable image or an unreadable image on a paper when the specific document detection unit detects the image data of the specific document.

12. The image forming apparatus as claimed in claim 11, wherein the memory stores revolution speed of a scanner driving motor as data for controlling the scanner moving speed by the CPU.

13. An image forming apparatus equipped with a scanner which reads images of both documents moving by an automatic document feeder and fixed documents and is fixed when reading moving document images and moved when reading fixed document images, and forms an image based on the read image data, comprising:

a memory to store a first magnification conversion table that is used when a document is conveyed using the automatic document feeder and reads an image by the scanner and a second magnification conversion table that is used when reading an image by the moving scanner by fixing a document;

a specific document detection unit to detect whether the read image data is that of a specific document;

a CPU to make the judgement as to whether an image that is moving by the automatic document feeder or a document is fixed to be read by the moving scanner when a copying magnification is set, wherein the CPU further makes:

a first convering to convert the copying magnification set using the first magnification conversion table stored in the memory to the reading magnification using the automatic document feeder when the reading of an image of a document moving using the automatic document feeder was judged;

a first setting-up to set the reading magnification that was converted by the first convering in the automatic document feeder and the specific document detection unit;

a second converting to convert the copying magnification set using the second magnification conversion table stored in the memory to the reading magnification by the scanner when the image was read by the moving scanner by fixing a document; and a second setting-up to set the reading magnification converted by the second converting unit in the scanner and the specific document detection unit.

* * * * *

UNITED STATES PATENT AND TRADEMARK OFFICE

CERTIFICATE OF CORRECTION

PATENT NO. : 7,224,931 B2
APPLICATION NO. : 11/009920
DATED : May 29, 2007
INVENTOR(S) : Ide et al.

It is certified that error appears in the above-identified patent and that said Letters Patent is hereby corrected as shown below:

Column 3 line 44, replace "□" with --.--.

Column 10 line 33, replace "convened" with --converted--.

Column 10 line 44, replace "convened" with --converted--.

Signed and Sealed this

Eighth Day of April, 2008

JON W. DUDAS
*Director of the United States Patent and Trademark Office*